US007503629B2

(12) United States Patent
Klabisch et al.

(10) Patent No.: US 7,503,629 B2
(45) Date of Patent: Mar. 17, 2009

(54) PICK LOCKING DEVICE INCLUDING A CLAMP ELEMENT AND A RETAINING PIN

(75) Inventors: Adam Klabisch, Dortmund (DE); Gerhard Siepenkort, Lünen (DE); Klaus Duhnke, Bochum (DE); Norbert Hesse, Bochum (DE); Uwe Tillessen, Kamen (DE)

(73) Assignee: DBT GmbH (DE)

( * ) Notice: Subject to any disclaimer, the term of this patent is extended or adjusted under 35 U.S.C. 154(b) by 86 days.

(21) Appl. No.: 11/044,635

(22) Filed: Dec. 28, 2004

(65) Prior Publication Data

US 2008/0007107 A1 Jan. 10, 2008

(30) Foreign Application Priority Data

Dec. 29, 2003 (DE) ..... 203 20 164 U

(51) Int. Cl.
*E21C 25/08* (2006.01)

(52) U.S. Cl. ..... 299/113; 299/103; 37/456

(58) Field of Classification Search ..... 299/102, 299/85.2, 103, 113; 37/452, 455, 456, 460
See application file for complete search history.

(56) References Cited

U.S. PATENT DOCUMENTS 2,055,265 A * 9/1936 Swigert, Jr. ..... 37/456
2,439,400 A * 4/1948 Simmons ..... 299/102
3,704,753 A * 12/1972 Hasforth et al. ..... 172/700
5,075,986 A * 12/1991 Smith et al. ..... 37/457
5,143,163 A * 9/1992 Stiffler et al. ..... 175/385
5,184,412 A * 2/1993 Kopinski et al. ..... 37/457
5,617,655 A * 4/1997 Launder et al. ..... 37/457
2006/0087169 A1* 4/2006 Hesse et al. ..... 299/101

FOREIGN PATENT DOCUMENTS

DE 29707967 U1 * 7/1997
DE 29803944 U1 * 4/1998

* cited by examiner

*Primary Examiner*—Jennifer H Gay
*Assistant Examiner*—Daniel P Stephenson
(74) *Attorney, Agent, or Firm*—Baker & McKenzie LLP

(57) ABSTRACT

A pick locking device for a plow pick that includes a pick shank inserted into a receptor box of a pick holder. The locking device may include a retaining pin and a deformable clamp element. The retaining pin may be forced through an opening on the pick holder into a locking groove extending in a shank insert direction along one side face of the shank. The clamp element may secure the retaining pin in a locked position, and may include a first leg and a second leg positioned at an angle to each other. The first leg may be inserted into a retainer in the pick shank and the second leg may be inserted into a locking recess on the retaining pin. The second leg may include a trunnion protruding from the first leg and an annular enclosed opening that extends to a rear of the first leg.

14 Claims, 1 Drawing Sheet

PICK LOCKING DEVICE INCLUDING A CLAMP ELEMENT AND A RETAINING PIN

CROSS-REFERENCE TO RELATED APPLICATIONS

This application claims priority from German patent application number 20320164, filed on Dec. 29, 2003.

BACKGROUND OF THE INVENTION

The invention relates to a pick locking device for a plow pick with a pick shank that can be inserted into an receptor box of a pick holder, with a retaining pin capable of being forced through an opening located on the face of the pick shank into a locking groove that runs in the direction of insertion along one side face of the tool shank, where a deformable plastic clamp element with two legs positioned at an angle to each other is provided in order to secure the retaining pin in its locking position, and where the one leg of the plastic clamp element is inserted into a retainer in the pick shank and the other leg inserts into a corresponding locking recess formed on the retaining pin. The invention particularly relates to the clamp element for such pick locking device, consisting of a deformable plastic material and including two legs positioned at an angle to each other of which one can be inserted into a retainer in the pick shank and the other is designated for engaging in a locking recess on the retaining pin, as well as a retaining pin for the pick locking device.

The generic pick locking device known from DE 297 07 967 U1 employs a one-piece plastic profiled elbow which has a groove with open edges running along the rear of both legs that is inserted into a corresponding profiled elbow holding device in the pick shank so that said elbow grips and clamps the retaining pin on both sides with both of its legs, i.e., on the bottom groove and on the side groove. In this known pick locking device, the elbow holding fixture consists of a trough-shaped recess into which the elbow clamp element is inserted. At the same time, the elbow clamp element inserts into a locking recess which runs around the perimeter of the retaining pin in the form of a groove, thus securing the bolt against accidental unlocking. Both legs have a convex cross-section and the cross section of the groove at the rear or both legs is made with a concave cross-section in order to achieve the required elasticity of the clamp element. The pick locking device known from DE 297 07 967 U1 generally fulfils its purpose satisfactorily, however, due to the complicated shape of the profiled elbow clamp element and the corresponding recess in the tool shank is comparatively difficult to realize and is relatively expensive.

DE 298 03 944 U1 proposes a split clamp element design with separate elastic chuck pieces, positioned at an appropriate distance from each other and held in holding fixtures in the pick shank that are arranged at a corresponding distance; here, the one elastic chuck piece on the inner groove flank and the other on the groove bottom projects into the locking groove of the pick shank against the retaining pin. In this instance, both the elastic chuck pieces are made as clamping pins in the form of sleeves and/or as solid material pins, preferably comprised of plastic.

BRIEF SUMMARY OF THE INVENTION

The object of the invention is to provide a pick locking device as well as a clamp element and an associated retaining pin which can be manufactured inexpensively, and which can be installed and dismantled easily while ensuring a high degree of safety in the locking position.

This object with respect to the pick locking device is solved in that the bolt leg projecting into the locking recess consists of a trunnion that protrudes from the front of the lower leg which can be inserted into the recess, said trunnion comprising an annular enclosed opening that extends to the rear of the lower leg. With respect to the clamp element, this object is achieved in that one of the legs is made as a bolt leg and consists of a trunnion that protrudes from the front of the lower leg which can be inserted into the recess, in which the bolt leg is made with an all round enclosed opening that extends to the rear of the lower leg. This all round enclosed opening in the trunnion achieves a high degree of dimensional stability and at the same time sufficient, almost elastic deformability of the bolt leg. In this manner, the bolt leg of the clamp element can be elastically deformed for short periods when the retaining pin is driven in and can then return to its original form without excessive deformation. The clamp element then bears against the retaining pin on both sides, whereby both the front of the trunnion as well as the lower leg exert a clamping force on the retaining pin. The single-piece plastic clamp element with the integral trunnions on the lower leg is comparatively easy to manufacture.

In a preferred embodiment of the pick locking device according to the invention, the retainer in the pick shank consists of a cavity with open edges that extends transversely in relation to the locking groove where the groove bottom is deeper and projects beyond one side of the groove. This recess can be realized without problems using plow picks made up of castings.

In another preferred embodiment of the pick locking device according to the invention or the clamp element according to the invention, the trunnion can be made in annular form with a circular, central opening. The thickness of the annular wall of the trunnion can be adapted to the forces to be absorbed simply by changing the diameter of the opening.

It is particularly advantageous, if the lower leg has a basic oval cross section, so that the clamp element can fill the retainer in the pick shank with a positive fit. The lower leg, which is stronger compared to the trunnion, facilitates the manipulation of the clamp element. Since the lower leg does not have a longitudinal groove as found in the state-of-the art clamp element, there is no danger that the lower leg will be compressed before insertion into the recess, and thus would no longer provide a secure hold in the retainer. Moreover, because the legs are made differently, this facilitates the correct assembly of the clamp element. It is particularly advantageous, if the trunnion is made eccentrically positioned on one end of the lower leg, thus making the clamp element L-shaped. Preferentially, the rear of the lower leg can furthermore be spherical and/or convex. In a particularly preferred embodiment, the rear of the lower leg comprises several recesses. These recesses can in particular be comprised of several grooves that are arranged side by side. On this occasion, the grooves form a corrugation on the rear, which produces a small increase in the elasticity of the clamp element in the lower leg relative to a lower leg made of solid material. At the same time, due to the corrugation, any fine coal deposits on the bottom of the recess in the pick shank will have no negative effects. It is particularly preferred if the grooves are made in an angular V-shape, where the apexes of all grooves are preferably arranged in one line that intersects the opening in the center. Furthermore, it is preferable for the lower leg to be more than twice as long as the trunnion on its front, and/or the front of the lower leg slopes toward the oval outer edge of the plastic clamp element by way of a bevel.

Finally, the invention also relates to a retaining pin for a pick locking device according to the invention, where the shaft according to the invention has a square cross section in which on the two transverse sides of the bolt shaft that are parallel to each other semi-cylindrical troughs are made in form of locking recesses. The retaining pin is preferably made as a mirror image in relation to the two transverse sides consisting of the troughs, thus enabling it to be forced into the pick holder in two different alignments. Moreover, the retaining pin preferably tapers toward the shaft tip on both longitudinal sides that connect the transverse sides.

BRIEF DESCRIPTION OF THE SEVERAL VIEWS OF THE DRAWINGS

Additional features and advantages of the invention result from the following specification and the drawings, which describes an example of a preferred embodiment of the invention in detail, in which.

DETAILED DESCRIPTION OF THE INVENTION

Figure 1:
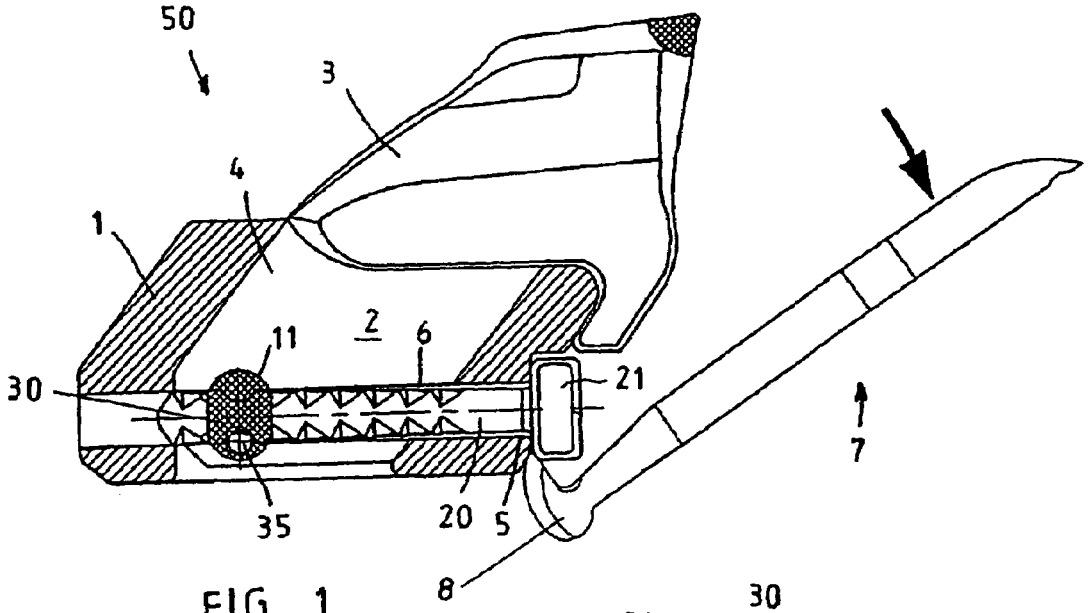
FIG. 1 shows a schematic diagram of a pick locking device as a cutaway view of a pick box with an inserted pick.

FIG. 1 reference 50, describes a plow pick arrangement consisting of a pick holder 1 with a plow pick 3 with its pick shank 4 is inserted into the receptor box 2. FIG. 1 shows the locking position of the pick 3 in the pick holder 1, which is secured by means of a pick locking device, which consists of a retaining pin 20, which is driven in through a corresponding opening 5 in the front of the pick holder 1 and inserts into a locking groove 6 into the side of the pick shank 4 that is facing away from the pick shank in the plane of the drawing, as well as plastic clamp element, generally designated as 30, which secures the retaining pin 20 in its locking position. The diagram in FIG. 1 also indicates a disassembly tool 7 with a pointed, hook-shaped tool head 8 that is provided for loosening the retaining pin 20 and which wedges in below the bevel of the retaining pin head 21 in order to remove the retaining pin 20 from the locking position represented in the diagram.

Figure 2:
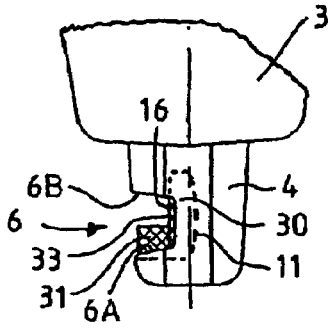
FIG. 2 shows a section of a pick shank with the inserted clamp element.

As is clearly shown in FIG. 1 and FIG. 2, the oval plastic clamp element 30 as shown in the plan view cross section, fits into a retainer 11 in the pick shank 4, which extends transversely in relation to the locking groove 6 in the one shaft side of the pick shank 4 and at the same time projects beyond groove flanks 6*a*, 6*b* of the locking groove 6. The diagram in FIG. 2 indicates that the retainer 11 for the clamp element 30 opposite to the groove bottom 16 of the locking groove 6 forms a recess. One trunnion 31 of the clamp element 30 protrudes into the locking groove 6 in the pick shank 4. Moreover, the top side 33 of the clamp element also protrudes a little beyond the groove bottom 16 of the locking groove 6.

Figure 3:
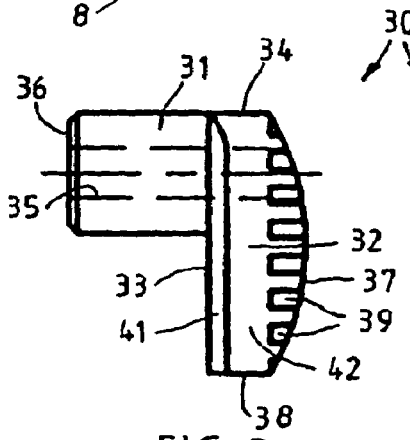
FIG. 3 shows the clamp element according to the invention for a pick locking device in side view.
Figure 4:
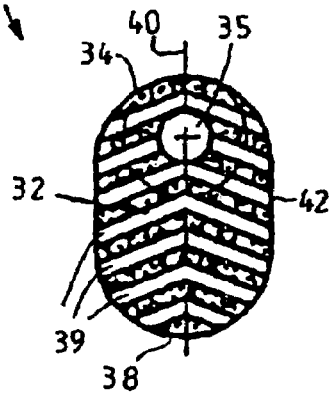
FIG. 4 shows a view of the rear of the clamp from FIG. 3

FIGS. 3 and 4 provide initial details of the clamp element 30 design. The clamp element 30 is made at an angle, from comparatively rigid plastic material and consists of a lower leg 32, on the front 33 of which, eccentric relative to the top end 34, a trunnion 31 projects, which forms the locking leg of clamp element 30. The trunnion 31 is annular with a circular cross section and has a circular, central opening 35 that extends over the full length from the front face 36 of the trunnion 31 through to the rear 37 of the lower leg 32. The opening 35 provides the trunnion 35 with extensive elasticity, i.e. it can be deformed without damage. The material used for the plastic element does not have to be elastic itself, but should be of sufficient hardness and rigidity. The lower leg 32 has a basic oval form with two opposed hemispherical ends 34, 38, with a spherical rear 37 between both ends. The rear 37 of the clamp element 30 has several V-shaped angular grooves 39 that are arranged side by side; these grooves extend at a uniform depth relative to the front 33, and the apexes of all V-shaped grooves 39 are arranged in a straight common line, which coincides with the plane of symmetry for the clamp element 30 and intersects the center of the circular opening 35. The top side 33, except in the area of for the trunnion 31 at the top end 34, slopes toward the side wall 42 of the clamp element 30 by way of a bevel 41. As previously mentioned, the trunnion 31 serves to engage into a locking recess on the shank of the retaining pin 20 while the top side 33 bears laterally against the retaining pin in the area surrounding the trunnion 31.

Figure 5:
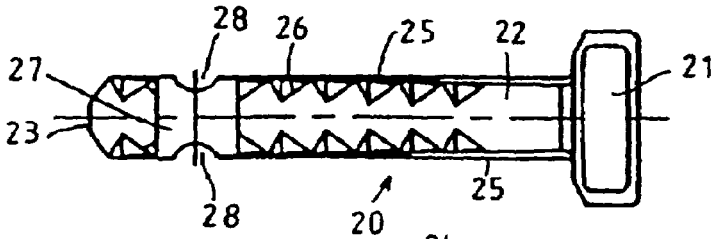
FIG. 5 shows a schematic diagram of a retaining pin according to the invention in side view.
Figure 6:
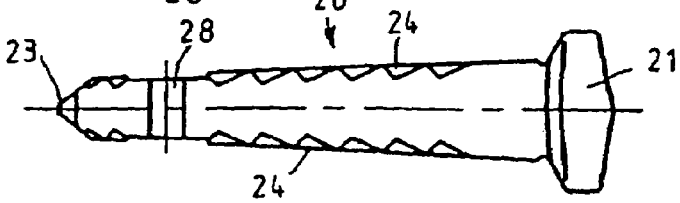
FIG. 6 shows the retaining pin from FIG. 5, rotated by 90°.

The design of the retaining pin 20 is explained by making reference to FIGS. 5 and 6. The retaining pin 20 includes a bolt head 21 as well as a bolt shank 22 that has rectangular cross-section, where the bolt shank 22 tapers from the bolt head 21 toward the bolt tip 23 on the two opposite longitudinal sides 24, while both the other opposite transverse sides 25 run parallel to each other. The shank 22 has sawtooth-shaped recesses 26 and includes a semi-cylindrical locking recess 28 in form of a trough with open edges. The locking recess 28 has a uniform cross section that extends along the entire transverse side 25, and the locking recess 28 forms the interacting abutment area of the retaining pin 20 for the pick locking device in conjunction with the deformable trunnion 31 of the clamping component 30 (FIG. 3).

It can be seen from FIG. 1, that in the locking position, the clamp element 30 inserts the trunnion (31, FIG. 3) into the locking recess (28, FIG. 5) on the retaining pin 20. For this purpose, the trunnion is briefly deformed during the assembly of the retaining pin 20, at which point the opening 35 in the trunnion of the clamp element 30 provides the necessary resilience. As soon as the retaining pin 20 occupies its locking position, the trunnion of the clamp element 30 can relax, since its central axis is then aligned with the locking recess 28, at the same time securing the retaining pin 20 against detaching or loosening. FIG. 2 clearly shows that the clamp element 30 also bears against the retaining pin 20 (27, FIG. 5) with the section of front 33 that protrudes beyond the groove bottom 16. This exerts an additional clamping force on the retaining pin 20 perpendicular in relation to the locking groove or perpendicular in relation to its shank expansion, so that the total combined clamping forces act on both sides of the bolt shank 22 of the retaining pin 20.

For persons skilled in the art, the aforementioned description, there would be several deviations that are protected by the appended claims. The opening is circular only in the preferred version and other geometries can also be used for the opening.

The invention claimed is:

1. A locking device operable for locking a plow pick having a pick shank that is inserted into a receptor box of a pick holder, the locking device comprising:

a retaining pin located in an opening on a face of the pick holder and in a locking groove; and a deformable clamp element for securing the retaining pin, the deformable clamp element including a first leg operable for insertion into a retainer in the pick shank and a second leg operable for insertion into a corresponding locking recess located on the retaining pin, wherein the first leg and the second leg are positioned at an angle to each other;

the second leg includes a trunnion that protrudes from a front of the first leg and projects into the locking recess;

the trunnion includes an annular enclosed opening that extends to a rear of the first leg; and the first leg has an oval cross section.

2. The locking device of claim 1, further comprising a cavity having open edges and located in the retainer in the pick shank, wherein the cavity extends transversely relative to the locking groove;

the cavity is deeper than a groove bottom; and the cavity projects beyond one groove flank of the locking groove.

3. The locking device of claim 1, wherein the trunnion is annular; and the trunnion has a circular central opening.

4. The locking device of claim 1, wherein the trunnion is positioned on one end of the first leg.

5. The locking device of claim 1, wherein the rear of the first leg is hemispherical.

6. The locking device of claim 1, wherein the rear of the first leg includes a plurality of recesses.

7. The locking device of claim 6, further comprising a plurality of grooves located within the plurality of recesses of the rear of the first leg, wherein the plurality of grooves are arranged next to each other.

8. The locking device of claim 7, wherein the plurality of grooves include V-shaped angular grooves having apexes;

the apexes of each of the grooves are arranged in a line; and the line intersects the annular enclosed opening.

9. The locking device of claim 1, wherein a length of the first leg is more than double a length of the trunnion.

10. The locking device of claim 1, wherein the front of the first leg slopes toward an oval outer edge of the clamp element via a bevel.

11. The locking device of claim 1, wherein the retaining pin includes a bolt shank having a rectangular cross section; and the bolt shank includes a plurality of semi-cylindrical troughs formed as locking recesses on two opposite and parallel transverse sides of the bolt shank.

12. The pick locking device of claim 11, wherein the retaining pin is symmetric with respect to both of the two transverse sides that include the semi-cylindrical troughs.

13. The locking device of claim 11, further comprising a shaft tip located on the retaining pin, wherein the retaining pin tapers toward the shaft tip on two longitudinal sides that connect the two transverse sides that include the semi-cylindrical troughs.

14. A clamp element for a locking device operable for securing a retaining pin in a locking position, the retaining pin locking a plow pick having a pick shank that is inserted into a pick box, the clamp element comprising:

a first leg formed of a deformable material and operable for insertion into a retainer in the shank;

a second leg formed of a deformable material and positioned at an angle to the first leg, the second leg being operable for insertion into a locking recess located on the retaining pin and including a trunnion that protrudes from a front of the first leg; and an annular enclosed opening located in the trunnion, wherein the second leg forms a locking leg;

the annular enclosed opening extends to a rear of the first leg; and the first leg has an oval cross section.

* * * * *

UNITED STATES PATENT AND TRADEMARK OFFICE

CERTIFICATE OF CORRECTION

PATENT NO. : 7,503,629 B2
APPLICATION NO. : 11/044635
DATED : March 17, 2009
INVENTOR(S) : Adam Klabisch et al.

It is certified that error appears in the above-identified patent and that said Letters Patent is hereby corrected as shown below:

In the claims, Column 6:

line 24 claim 11: Please insert --pick-- and replace the line to read --insertion into a retainer in the pick shank;--

Signed and Sealed this

Twenty-third Day of June, 2009

John Doll

JOHN DOLL
*Acting Director of the United States Patent and Trademark Office*